US011230863B2

(12) United States Patent
Manolescu et al.

(10) Patent No.: US 11,230,863 B2
(45) Date of Patent: Jan. 25, 2022

(54) LATCHING SYSTEM AND LATCHING METHOD UTILIZING RHEOLOGICAL MATERIAL

(71) Applicant: Ford Global Technologies, LLC, Dearborn, MI (US)

(72) Inventors: Constantin Manolescu, Rochester Hills, MI (US); Erin Rose Briggs, Detroit, MI (US); David Manuel Rogers, Ferndale, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 959 days.

(21) Appl. No.: 15/890,579

(22) Filed: Feb. 7, 2018

(65) Prior Publication Data

US 2019/0242160 A1 Aug. 8, 2019

(51) Int. Cl.

| | |
|---|---|
| ***E05B 77/38*** | (2014.01) |
| ***E05B 81/08*** | (2014.01) |
| ***E05B 79/10*** | (2014.01) |
| ***E05B 79/08*** | (2014.01) |

(52) U.S. Cl.

CPC ..... *E05B 77/38* (2013.01); *E05B 79/08* (2013.01); *E05B 79/10* (2013.01); *E05B 81/08* (2013.01)

(58) Field of Classification Search

None

See application file for complete search history.

(56) References Cited

U.S. PATENT DOCUMENTS

| | | | | |
|---|---|---|---|---|
| 3,338,612 | A * | 8/1967 | Howard | E05B 63/127 292/340 |
| 5,064,229 | A * | 11/1991 | Hamada | E05B 77/38 292/216 |
| 5,632,517 | A | 5/1997 | Paulik et al. | |
| 6,024,389 | A | 2/2000 | Arabia, Jr. et al. | |
| 6,595,561 | B1 * | 7/2003 | Szablewski | E05B 81/18 292/341.16 |
| 8,342,582 | B2 | 1/2013 | Bendel et al. | |
| 8,348,309 | B2 | 1/2013 | Patel et al. | |
| 8,631,608 | B1 | 1/2014 | Konchan et al. | |

(Continued)

FOREIGN PATENT DOCUMENTS

| | | | |
|---|---|---|---|
| DE | 19801752 C1 * | 5/1999 | E05C 19/02 |
| WO | 2004001170 | 12/2003 | |

OTHER PUBLICATIONS

Computer Generated Translation for DE 19801752, Generated on Nov. 18, 2020, https://worldwide.espacenet.com/ (Year: 2020).*

(Continued)

*Primary Examiner* — Alyson M Merlino

(74) *Attorney, Agent, or Firm* — David Coppiellie, Esq.; Carlson, Gaskey & Olds, P.C.

(57) ABSTRACT

An exemplary latching system includes, among other things, a striker, a latch assembly that engages the striker to transition the latch assembly to a latched position, and a bumper containing rheological material. The bumper contacts the striker when the latch assembly is in the latched position. An exemplary latching method includes, among other things, contacting a striker with a bumper when a latch assembly engages the striker in a latched position, and increasing a hardness of the bumper by aligning particles within rheological material of the bumper.

15 Claims, 4 Drawing Sheets

(56) References Cited

U.S. PATENT DOCUMENTS

| | | | | |
|---|---|---|---|---|
| 2008/0086916 | A1* | 4/2008 | Ellis | A42B 3/121 36/103 |
| 2009/0044378 | A1* | 2/2009 | Jankowski | E05B 77/06 292/198 |
| 2016/0305170 | A1* | 10/2016 | Berger | E05B 77/38 |

OTHER PUBLICATIONS

"Chapter 18: Rheological Behaviour of Natural Rubber Based Blends," Dec. 5, 2013, https://pubs.rsc.org/en/content/chapter/bk9781849736107-00394/978-1-84973-610-7 (Year: 2013).*

"Bladder—Definition from Merriam-Webster," www.merriam-webster.com/dictionary/bladder (Year: 2021).*

* cited by examiner

LATCHING SYSTEM AND LATCHING METHOD UTILIZING RHEOLOGICAL MATERIAL

TECHNICAL FIELD

This disclosure relates generally to a latching system for a vehicle. More particularly, the disclosure relates to a latching system that incorporates a bumper containing rheological material.

BACKGROUND

A vehicle can include a first member, a second member, and a latching system. The first member can be moveable relative to the second member between an open and closed position. The latching system secures the first member relative to the second member when the first and second members are in the closed position.

In one example, the first member can be a door and the second member a vehicle frame. When the door is closed, a latch assembly of the latching system engages a striker mounted on the vehicle frame to secure the door to the vehicle frame. In another example, the first member can be a deck lid. When the deck lid is closed, a latch assembly engages a striker of the vehicle frame to secure the deck lid to the vehicle frame.

The latching system can include a compressible bumper. When the latching system is securing the first member to the second member, the bumper can press against portions of the latch assembly, the vehicle frame, or both to address movements of the first member relative to the second member. The relative movements can be caused by vibrations as the vehicle is operated. The relative movements can result in noise as the first member and second member contact each other. Some bumpers can be incorporated to instead, or additionally, address noise, vibration, harshness, buzzes, squeaks, rattles, or some combination of these. The bumpers can influence closing and opening efforts associated with moving the first member relative to the second member.

SUMMARY

A latching system according to an exemplary aspect of the present disclosure includes, among other things, a striker, a latch assembly that engages the striker to transition the latch assembly to a latched position, and a bumper containing rheological material. The bumper contacts the striker when the latch assembly is in the latched position.

In a further non-limiting embodiment of the foregoing system, the bumper includes a bladder filled with the rheological material.

In a further non-limiting embodiment of any of the foregoing systems, the bladder includes a rubber material.

A further non-limiting embodiment of any of the foregoing systems includes an electromagnet that is selectively activated to align ferrous particles of the rheological material. The ferrous particles are disposed within a carrier fluid.

In a further non-limiting embodiment of any of the foregoing systems, aligning the ferrous particles increases a durometer of the bumper to bias a portion of the latch assembly against the striker.

In a further non-limiting embodiment of any of the foregoing systems, aligning the ferrous particles increases a hardness of the bumper to bias a portion of the latch assembly against the striker.

A further non-limiting embodiment of any of the foregoing systems includes a vehicle door. The latch assembly is mounted on the vehicle door.

In a further non-limiting embodiment of any of the foregoing assemblies, the bumper is mounted on the vehicle door.

In a further non-limiting embodiment of any of the foregoing assemblies, the rheological material is electrorheological fluid.

A latching method according to an exemplary aspect of the present disclosure includes, among other things, contacting a striker with a bumper when a latch assembly engages the striker in a latched position, and increasing a hardness of the bumper by aligning particles within rheological material of the bumper.

In a further non-limiting embodiment of the foregoing method, the increasing is after the contacting.

A further non-limiting embodiment of any of the foregoing methods includes holding the rheological material within a bladder.

A further non-limiting embodiment of any of the foregoing methods includes activating an electromagnet to cause the increasing.

In a further non-limiting embodiment of any of the foregoing methods, increasing the hardness of the bumper biases a portion of the latch assembly against the striker.

In a further non-limiting embodiment of any of the foregoing methods, increasing the hardness of the bumper increases an apparent viscosity of the rheological material.

A further non-limiting embodiment of any of the foregoing methods includes decreasing the hardness prior to transitioning the latch to an unlatched position.

A further non-limiting embodiment of any of the foregoing methods, includes decreasing the hardness in response to a vehicle transitioning from a drive gear to a parked gear.

In a further non-limiting embodiment of any of the foregoing methods, the particles are ferrous particles.

In a further non-limiting embodiment of any of the foregoing methods, the rheological material is electrorheological fluid.

The embodiments, examples and alternatives of the preceding paragraphs, the claims, and the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
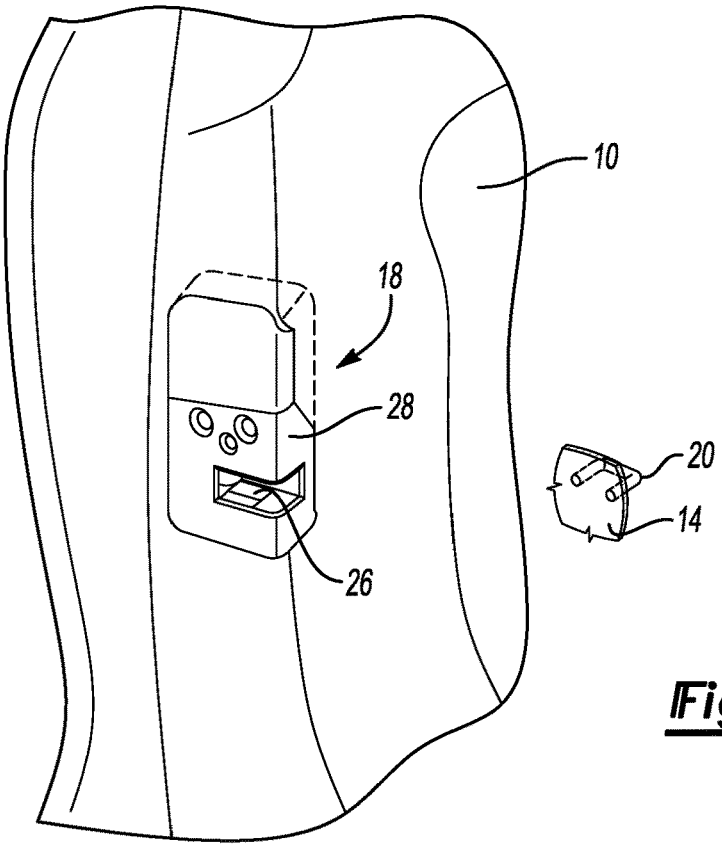
FIG. 1 shows a perspective view of a latch assembly within a first member where the first member, here a door, is in an open position relative to a second member, and the latch assembly is disengaged from a striker.
Figure 2:
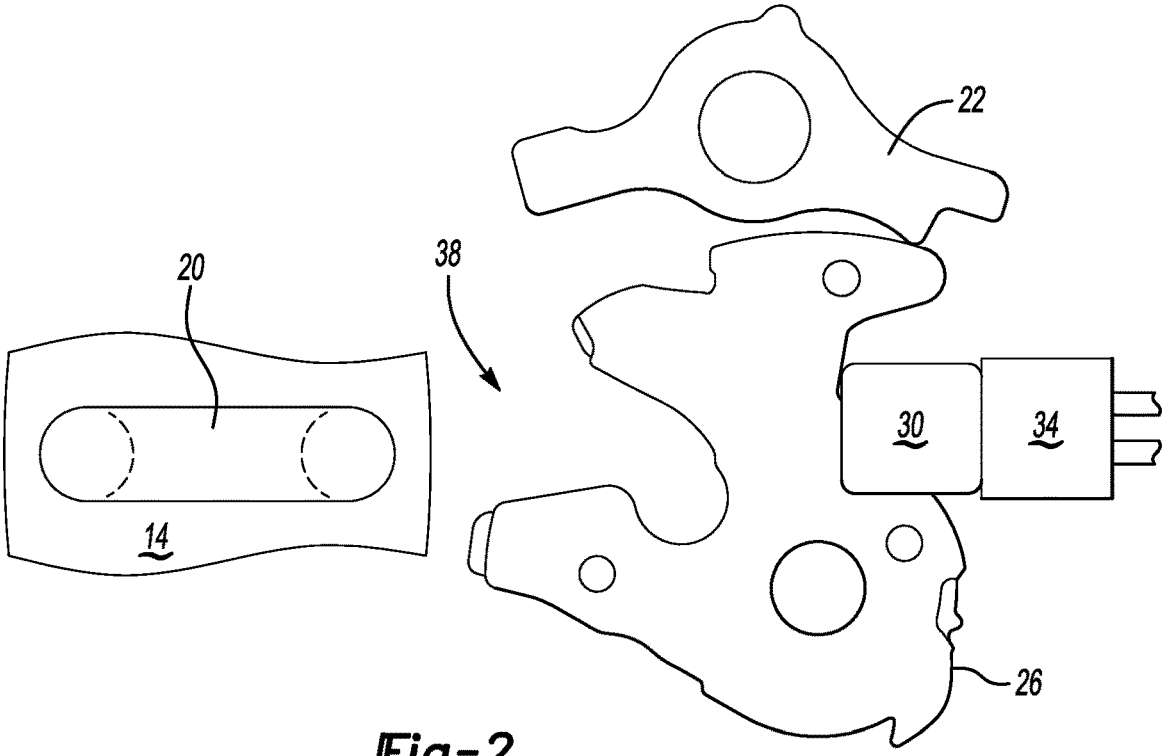
FIG. 2 illustrates selected portions of the latch assembly of FIG. 1 showing the latch assembly disengaged from the striker.
Figure 3:
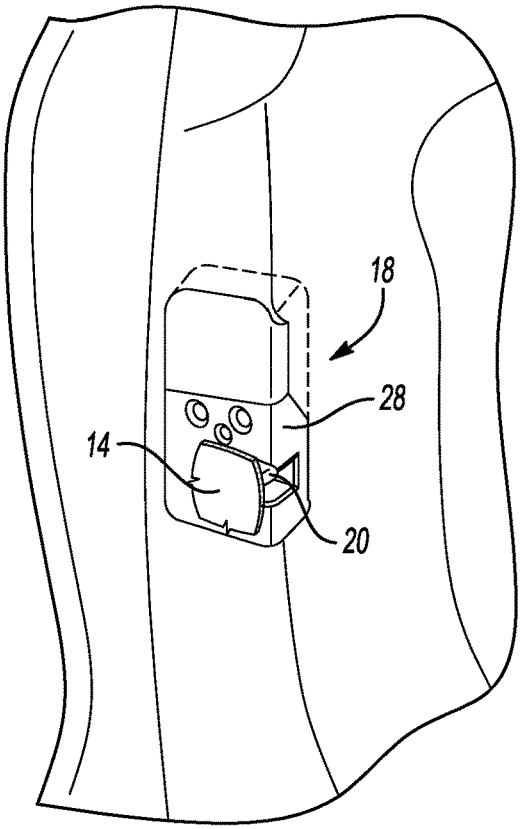
FIG. 3 illustrates the latch assembly of FIG. 1 when the door is in a closed position and the latch assembly is latched.
Figure 4:
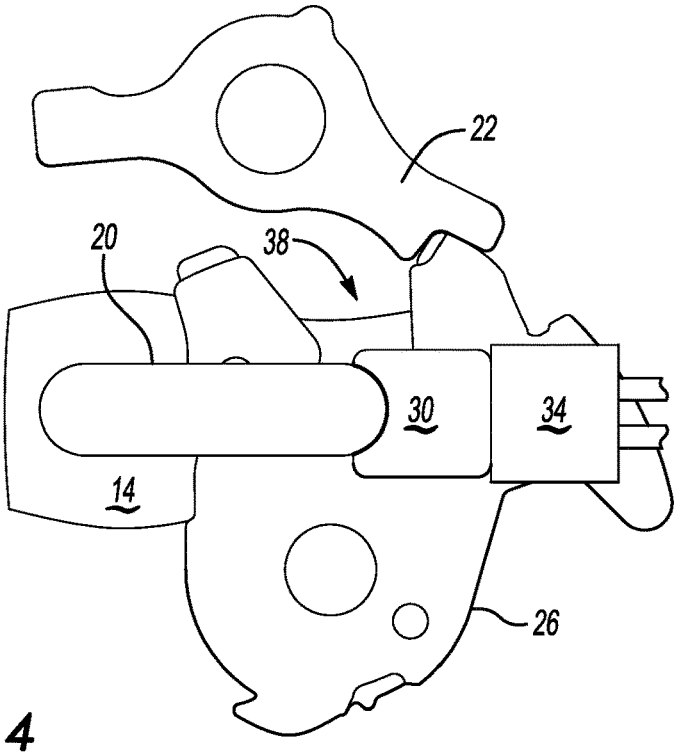
FIG. 4 illustrates the portions of the latch assembly in FIG. 2 when the latch assembly is latched.
Figure 5:
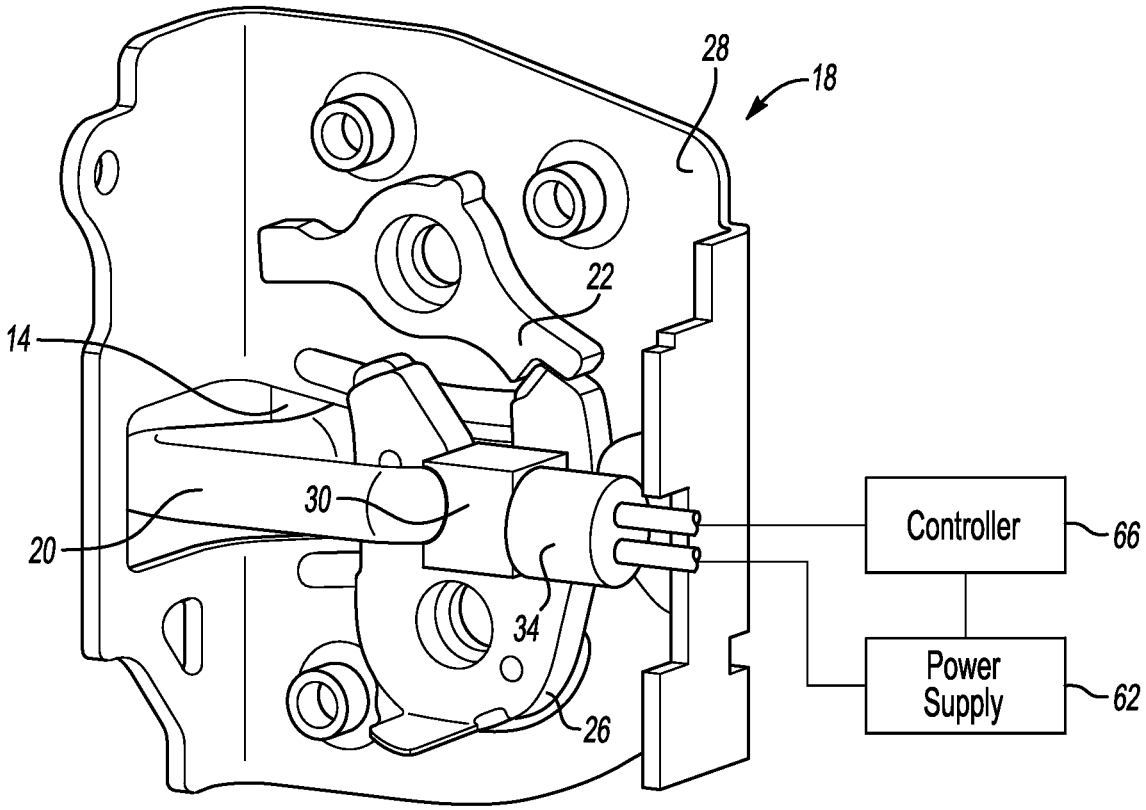
FIG. 5 illustrates a perspective view of the portions of the latch assembly of FIG. 3 when the latch assembly is engaging the striker.

This disclosure relates generally to a latching system for a vehicle. A bumper containing rheological material is incorporated within the latching system.

In an embodiment, an electromagnet can be activated to increase a hardness of the bumper, and can be deactivated to decrease a hardness of the bumper. Increasing the hardness of the bumper may be desirable when the members secured by the latching system are in a closed position. Decreasing the hardness of the bumper may be desirable when moving the members to the closed position, or when moving the members from the closed position.

The hardness of the bumper can be increased by activating a magnet, such as an electromagnet, near the bumper. A magnetic field from the activated magnet aligns ferrous particles within the bumper. The hardness of the bumper can be varied by changing electrical current supplied to the magnet, which changes the strength of the induced magnetic field.

Referring now to FIGS. 1-5, a vehicle includes a first member 10 and a second member 14. The first member 10 can be moved relative to the second member 14 back and forth between an open (i.e., ajar) position of FIGS. 1 and 2 and the closed position of FIGS. 3-5. The closed position could be a primary closed position where the first member 10 is fully closed, or a secondary closed position where the first member 10 is partially closed.

A latching system can be used to secure the first member 10 relative to the second member 14 in the closed position. The latching system can include, a latch assembly 18 and a striker 20. In an embodiment, the latch assembly 18 is disposed on the first member 10 and the striker 20 is a portion of the second member 14. In another embodiment, the latch assembly 18 could be incorporated within the second member 14 and the striker 20 within the first member 10.

When the first member 10 and the second member 14 are in the closed position, the latch assembly 18 can engage the striker 20. Engaging the striker 20 secures the first member 10 relative to the second member 14 in the closed position. When the latch assembly 18 engages the striker 20, the latch assembly 18 is in a latched position. When the latch assembly 18 is disengaged from the striker 20, the latch assembly 18 is in an unlatched position.

In the exemplary non-limiting embodiment, the first member 10 is a side door of the vehicle, and the second member 14 is a frame of the vehicle. A latch system having the latch assembly 18 could be utilized with other movable members of the vehicle, such as, for example, a deck lid that moves between an open and closed position relative to a vehicle frame.

The latch assembly 18 of the latch system can include, among other things, a pawl 22 and a ratchet 26 at least partially disposed within a housing 28. The latch system additionally includes a bumper 30 and an electromagnet 34, which are also, in this embodiment, at least partially disposed within the housing 28.

A supporting flange from the housing 28 (not shown) could be used to support the bumper 30, the electromagnet 34, or both. In another example, the bumper 30 and electromagnet 34 could be incorporated into the second member 14 rather than the first member.

As the second member 14 is moved to the closed position relative to the first member 10, an opening 38 of the ratchet 26 receives the striker 20. Contact between the striker 20 and the ratchet 26 the pivots the ratchet 26 from the position of FIG. 3 to the position of FIG. 4. The ratchet 26 is held in the position of FIG. 4 to hold the striker 20 thereby securing the first member 10 relative to the second member 14 in the closed position.

When the first member 10 is in the closed position relative to the second member 14 and the latch assembly 18 is engaged, the bumper 30 contacts the striker 20. In this example, the bumper 30 directly contacts the striker 20 when the first member 10 is in the closed position. That is, there are no other members disposed between the bumper 30 and the striker 20 in the area where the bumper 30 contacts the striker 20.

The bumper 30 compresses when the striker 20 directly contacts the bumper 30. Compressing the bumper 30 can soften the closing of the first member 10 relative to the second member 14. When the first member 10 is in the closed position, the bumper 30 compressed against the striker 20 can reduce relative movement of the first member 10 relative to the second member 14.

Figure 6:
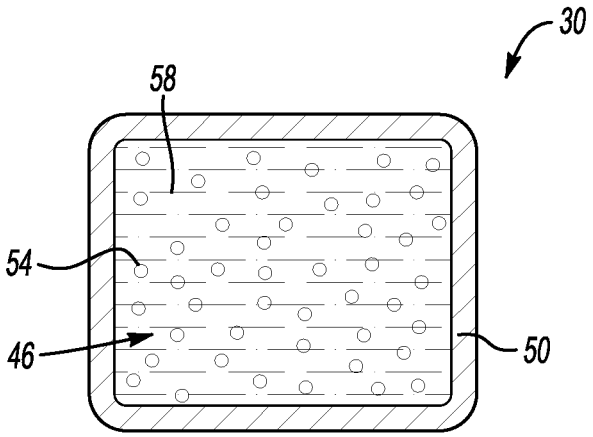
FIG. 6 illustrates a section view of a bumper used in connection with the latch assembly of FIG. 4.

Referring now to FIG. 6, the example bumper 30 includes rheological material 46 held within a bladder 50. The bladder 50 contains the rheological material 46. The bladder 50 can be a natural rubber material. The bladder 50 can be about 1 millimeter thick in some examples.

In the exemplary embodiment, the rheological material 46 is a magnetorheological fluid that includes a plurality of ferrous particles 54 carried within a carrier fluid 58. The ferrous particles 54 can be iron, for example, and the carrier fluid can be an oil. The rheological material 46, in another example, is an electrorheological fluid. As is known, magnetorheological fluids contain ferrous particles that react to a magnetic field, whereas an electrorheological fluids contain electrically active non-conductive particles that react to an electric field. In some examples, electrorheological fluids are suspensions of extremely fine non-conducting but electrically active particles (say up to 50 micrometers in diameter) in an electrically insulating fluid. The apparent viscosity of these fluids can change reversibly by an order of up to 100,000 in response to an electric field.

With reference again to FIG. 5, the electromagnet 34 is disposed adjacent to the bumper 30. The electromagnet 34 is operably coupled to a power supply 62 and a controller 66 of the vehicle. The power supply 62 can be a 12-Volt accessory battery of the vehicle, for example.

The controller 66 can be a battery control module (BCM) or another type of control unit, such as a door control unit ("DCU"). The controller 66 can control and monitor various electronic accessories associated with the first member 10 and the second member 14. Exemplary accessories can include lock switches, child locks, window controls, etc.

The controller 66 can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

The processor can be a hardware device for executing software, particularly software stored in memory that may include one or more separate programs, each of which includes an ordered listing of executable instructions for implementing logical functions. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory can include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.).

In the exemplary embodiment, the controller 66 can receive information from sensors that reveal a positioning of the first member 10 relative to the second member 14. For example, the sensors can provide to the controller 66 signals indicating that the first member 10 is in an open position relative to the second member 14, or a closed position relative to the second member 14. The signals could also indicate whether or not the latch assembly 18 is engaged with the striker 20 or disengaged from the striker 20.

The controller 66 can also control a flow of power from the power supply 62 to the electromagnet 34. By controlling the flow of power, the controller 66 can selectively activate and deactivate the electromagnet 34.

Activating the electromagnet 34 causes the ferrous particles 54 within the bumper 30 to align, which effectively increases a hardness of the bumper 30. In this example, a durometer of the bumper 30 when the electromagnet 34 is activated is higher than when the electromagnet 34 is deactivated. Also, as is understood by a person having skill in this art, when rheological material is exposed to a magnetic field, the viscosity of the rheological material can effectively increase.

In this exemplary embodiment, the controller 66, selectively activates the electromagnet 34 to harden the bumper 30 under some conditions, and selectively deactivates the electromagnet 34 to soften the bumper 30 under other conditions.

The controller 66 can activate the electromagnet 34 to harden the bumper 30 when the first member 10 is in a closed position relative to the second member 14 and the latch assembly 18 is engaged. Hardening the bumper 30 under these conditions effectively increases a compressive force exerted on the striker 20 by the bumper 30, which can help to reduce, among other things, chucking movements of the first member 10 relative to the second member 14 when the first member 10 is in a closed position.

Notably, the controller 66 can activate the electromagnet 34 after detecting that the first member 10 has moved to the closed position with the second member 14 and after detecting that the latch assembly 18 engaged. Prior to the first member 10 reaching the closed position with the second member 14, the electromagnet 34 remains deactivated so that the bumper 30 is relatively soft as the first member 10 is closed. The bumper 30, when relatively soft, can reduce the effort required to close the first member 10 when compared a closing of the first member when the bumper 30 is relatively hard.

Figure 7:
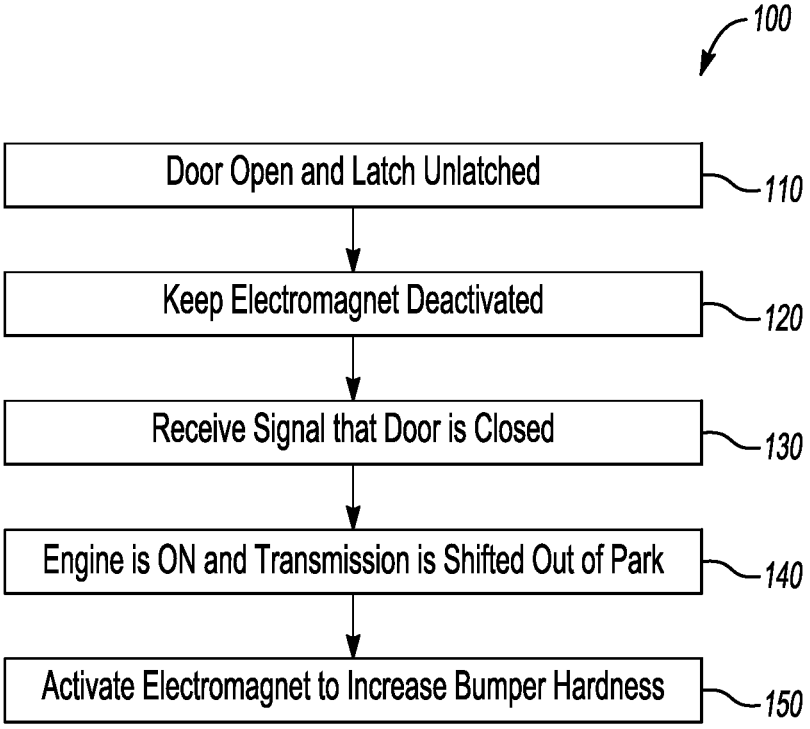
FIG. 7 illustrates an exemplary method of varying a hardness of the bumper of FIG. 6.
Figure 8:
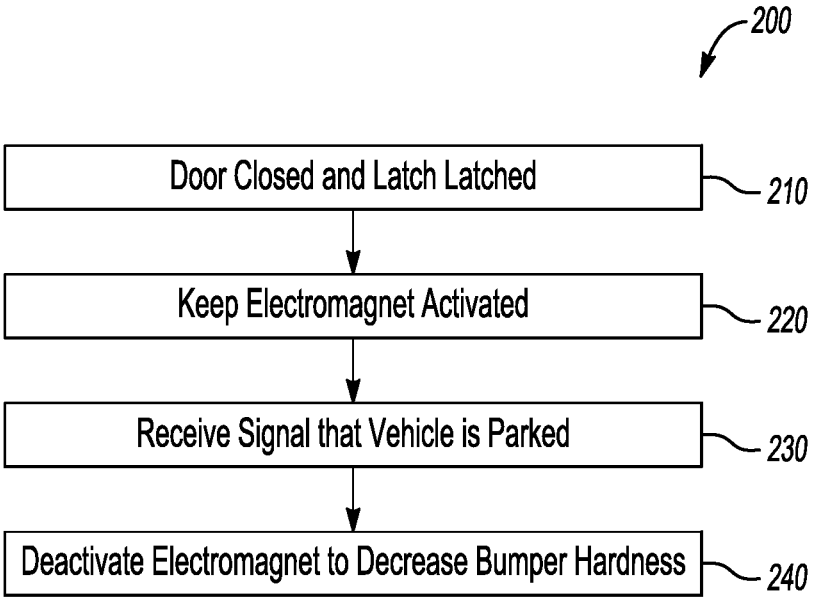
FIG. 8 illustrates an exemplary method of varying the hardness of the bumper of FIG. 6.

Referring now to FIG. 7 with continued reference to FIGS. 1-6, an exemplary method 100 executed by the controller 66 can begin at a step 110 where the first member 10, here the door, is in an open position relative to the second member 14, and the latch assembly 18 is unlatched. When the door is open and the latch is unlatched, the method 100 keeps the electromagnet 34 deactivated as shown at step 120, which keeps the bumper relatively soft.

Next, at a step 130, the controller 66 receives a signal that the door is closed. The signal could be in response to the ratchet 26 rotating an established amount, which indicates that the latch assembly 18 has engaged the striker 20. Waiting for such confirmation can ensure that the latch assembly 18 has fully engaged the striker 20 prior to increasing a hardness of the bumper 30, which would introduce the resulting reactive forces to the latch assembly 18 and striker 20.

The method 100 then waits for confirmation signals at step 140 that the engine is ON, and the transmission has been shifted out of Park. This step can ensures that no battery power is unnecessarily used when the vehicle is not moving. Looseness potentially leading to chucking or other noise is most likely to be apparent when the vehicle is moving.

At a step 150, the controller 66 activates the electromagnet 34 to increase the hardness of the bumper 30. Increasing the hardness solidifies the engagement of the striker 20 within the latch assembly 18.

Another exemplary method 200 utilized by the controller 66 can begin at a step 210 where the first member 10, here again the door, is closed and the latch assembly 18 is latched. When the door is closed and the latch is latched, the controller 66 keeps the electromagnet 34 activated to maintain a hardness of the bumper 30 at a step 220. The open and closed state of the door can be detected by a door ajar switch.

Next, the controller 66 receives, at a step 230, a signal that the vehicle has parked. Such a signal may indicate that the door is about to open due to a passenger, for example, exiting a passenger compartment of the vehicle. The signal indicating that the vehicle is parked could be a signal sent in response to a gear selector moving from a drive gear to a parked position.

In response to the signal at the step 230, the controller 66 deactivates the electromagnet 34 at a step 240 to decrease a hardness of the bumper 30. Decreasing the hardness can facilitate disengaging the latch assembly 18 and reduce efforts associated with opening the door. Because the vehicle when it is parked, looseness and chucking can be less objectionable. Thus, softening the bumper 30 when the vehicle is parked can be desirable in some examples.

Features of the disclosed examples include a latch assembly that incorporates a rheological material within a bumper so that the bumper can have a variable hardness/durometer. A controller can vary the durometer under certain situations to facilitate low closing efforts, and can harden the bumper to counteract movement of the first member relative to the second member when the latch is latched.

In some examples, the durometer of the bumper can be varied by changing how an electric field applied to the bumper. The electric field can be tuned after assembling the vehicle, or at different periods in the life of the vehicle, to provide the bumper with a desired durometer.

The bumper directly contacts a striker of the latching system. Directly contacting the striker can provide a relatively simple system. That is, added mechanical components between the striker and the bumper are not required. Further, the electric field can directly influence closing and opening efforts and the forces resulting from increasing the durometer of the bumper are applied directly to the striker and the latch assembly without passing through other mechanical components.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A latching system, comprising:

a striker;

a latch assembly that selectively engages the striker to transition the latch assembly to a latched state, the latch assembly mounted on one of a vehicle door or a vehicle frame, the striker mounted on the other of the vehicle door or the vehicle frame; and a bumper containing rheological material, the bumper contacting the striker when the latch assembly is in the latched state, wherein the bumper comprises a bladder filled with the rheological material, wherein the bladder includes a rubber material, wherein the bladder directly contacts the striker when the latch assembly is in the latched state, wherein, to reduce relative movement of a vehicle body relative to the vehicle body, a hardness of the bumper is configured to be increased by aligning particles within the rheological material of the bumper.

2. The latching system of claim 1, wherein the particles within the rheological material comprise ferrous particles, and further comprising an electromagnet that is selectively activated to align the ferrous particles of the rheological material, the ferrous particles are disposed within a carrier fluid.

3. The latching system of claim 2, wherein aligning the ferrous particles increases a durometer of the bumper to bias the bumper against the striker.

4. The latching system of claim 2, wherein aligning the ferrous particles increases the hardness of the bumper to bias the bumper against the striker.

5. The latching system of claim 1, further comprising the vehicle door, the latch assembly mounted on the vehicle door.

6. The latching system of claim 5, wherein the bumper is mounted on the vehicle door.

7. A latching method, comprising:

contacting a striker with a bumper when a latch assembly is engaging the striker in a latched state; and to reduce relative movement of a vehicle door relative to a vehicle body, increasing a hardness of the bumper by aligning particles within a rheological material of the bumper, wherein the rheological material is held within a bladder, wherein the bladder directly contacts the striker when the latch assembly is in the latched state.

8. The latching method of claim 7, wherein the increasing is after the contacting.

9. The latching method of claim 7, further comprising activating an electromagnet to cause the increasing step.

10. The latching method of claim 7, wherein the increasing of the hardness of the bumper biases a portion of the latch assembly against the striker.

11. The latching method of claim 7, wherein increasing the hardness of the bumper increases an apparent viscosity of the rheological material.

12. The latching method of claim 7, further comprising decreasing the hardness prior to transitioning the latch assembly to an unlatched state.

13. The latching method of claim 7, wherein the rheological material is electrorheological fluid.

14. The latching method of claim 7, wherein the striker is mounted to the vehicle body and the latch assembly is mounted to the vehicle door.

15. A latching method, comprising:

contacting a striker with a bumper when a latch assembly is engaging the striker in a latched state;

increasing a hardness of the bumper by aligning particles within a rheological material of the bumper;

decreasing the hardness of the bumper prior to transitioning the latch assembly to an unlatched state; and decreasing the hardness of the bumper in response to a vehicle transitioning from a drive gear to a parked gear.

* * * * *